US011525603B2

(12) United States Patent
Lambert

(10) Patent No.: US 11,525,603 B2
(45) Date of Patent: Dec. 13, 2022

(54) SACRIFICIAL ANODE AND METHOD FOR DETERMINING ANODE HEALTH FOR WATER HEATER EARLY WARNING SYSTEM

(71) Applicant: RadTech, LLC, Owens Cross Roads, AL (US)

(72) Inventor: Ross Lambert, Owens Cross Roads, AL (US)

(73) Assignee: Radtech, LLC, Owens Cross Roads, AL (US)

( * ) Notice: Subject to any disclaimer, the term of this patent is extended or adjusted under 35 U.S.C. 154(b) by 0 days.

(21) Appl. No.: 17/770,685

(22) PCT Filed: Oct. 29, 2020

(86) PCT No.: PCT/US2020/057924

§ 371 (c)(1),
(2) Date: Apr. 21, 2022

(87) PCT Pub. No.: WO2021/087089

PCT Pub. Date: May 6, 2021

(65) Prior Publication Data

US 2022/0364767 A1 Nov. 17, 2022

Related U.S. Application Data

(60) Provisional application No. 62/927,480, filed on Oct. 29, 2019.

(51) Int. Cl.
*F24H 9/45* (2022.01)
*F24H 15/104* (2022.01)

(52) U.S. Cl.
CPC ..... *F24H 9/455* (2022.01); *F24H 15/104* (2022.01)

(58) Field of Classification Search
CPC ..... F24H 9/455; F24H 15/104
See application file for complete search history.

(56) References Cited

U.S. PATENT DOCUMENTS 2,726,205 A * 12/1955 Kleinmann ..... F24H 9/45 204/196.07
3,037,920 A * 6/1962 Vixler ..... C23F 13/22 204/196.15

(Continued)

FOREIGN PATENT DOCUMENTS

CN 204063580 U * 12/2014
ZA 7407511 A * 10/1975 ..... C23F 13/04

OTHER PUBLICATIONS

CN204063580U text from search (Year: 2014).*

(Continued)

*Primary Examiner* — Nathaniel Herzfeld
(74) *Attorney, Agent, or Firm* — Dinsmore & Shohl LLP

(57) ABSTRACT

A sacrificial anode for a water heater system is provided. The anode may comprise a proximal end, a distal end, and a passage running longitudinally between the distal and proximal end. A first current carrying lead and a first voltage lead may be connected to the distal end of the anode, while a second current carrying lead a second voltage lead may be connected to the proximal end of the anode. The first current carrying lead and first voltage lead may be connected to the distal end of the anode in such a manner that the leads may be fed through the passage of the anode and protrude from the proximal end of the anode. A method of determining the health of a sacrificial anode is further provided, which involves utilizing the resistance drop across the anode to determine the radius of the anode during use.

18 Claims, 4 Drawing Sheets

(56) References Cited

U.S. PATENT DOCUMENTS

| | | | | |
|---|---|---|---|---|
| 3,132,081 | A * | 5/1964 | Sutton | C23F 13/04 204/196.05 |
| 4,975,560 | A * | 12/1990 | Wardy | F24H 9/45 204/196.05 |
| 2001/0045820 | A1 | 11/2001 | Kean et al. | |
| 2008/0047843 | A1 | 2/2008 | Glass et al. | |
| 2014/0262822 | A1 | 9/2014 | Knoeppel | |

OTHER PUBLICATIONS

International Search Report & Written Opinion issued in corresponding PCT Application No. PCT/US2020/057924 dated Mar. 30, 2021.

* cited by examiner

SACRIFICIAL ANODE AND METHOD FOR DETERMINING ANODE HEALTH FOR WATER HEATER EARLY WARNING SYSTEM

This application is a national-stage application under 35 U.S.C. § 371 of International Application No. PCT/US2020/0057924, filed Oct. 29, 2020, which claims the benefit of U.S. Provisional Patent Application Ser. No. 62/927,480, filed on Oct. 29, 2019, the disclosures of which are incorporated herein by reference.

INCORPORATION BY REFERENCE

All publications and patent applications mentioned in this specification are herein incorporated by reference to the same extent as if each individual publication or patent application was specifically and individually indicated to be incorporated by reference.

TECHNICAL FIELD

This document relates generally to water heater warning systems and, in particular, a sacrificial anode and method for determining the health of an anode in a water heater system.

BACKGROUND

Standard water heater systems typically include a steel tank outfitted with either heating elements or burners and are coated on the interior with a layer of porcelain. This porcelain serves as an insulating layer between the steel tank and a corrosive electrolyte inside the tank. Without the porcelain, the steel would gradually corrode until a leak is formed, which allows pressurized water a path out of the tank. However, the porcelain coating on the interior of the steel tank can often suffer from small cracks or chips that expose a small amount of the steel to the electrolyte inside the tank. Such a crack can be formed during the assembly of the water heater system or when the system is in transit. Furthermore, cracks and chips in the porcelain coating often occur as a result of thermal shock when spot welds are performed to fix leaks. Regardless of the manner in which the cracks are formed, the damaged porcelain layer exposes portions of the steel tank, which begin to corrode when contacting the water in the tank. As the steel corrodes, a leak begins to form, which can significantly diminish the expected service life of the water heater system. To remedy this issue, water heater system developers supplement the water heater with an anode rod, such as a magnesium alloy rod formed around a steel rod and inserted into the tank. The magnesium is typically held in electrical contact with the surrounding steel via a threaded connection, and is in constant contact with the same electrolyte that contacts the steel tank. Because magnesium has less nobility than steel, the magnesium rod forms a galvanic connection with the steel tank when exposed to water, and the magnesium anode rod gradually corrodes. As the anode corrodes, the rod loses magnesium ions to the water and provides electrons to the steel tank, which protects the steel from corrosion until the anode rod is depleted.

In order to prolong the life of water heater systems, the industry has attempted to take measures to slow down the degradation of sacrificial anodes. In some instances, anodes have been developed to include a resistor which runs in series with the anode, which helps to slow degradation of the anode. Although this solution is effective in slowing anode degradation, adding the resistor increases the risk of additional corrosion to the tank wall.

Other solutions to extend the service of life of water heaters have included adding a second anode to the tank or utilizing powered anodes. Unfortunately, each of these alternatives are expensive solutions which greatly increase the overall cost of the water heater system. Further solutions have involved efforts to measure galvanic current, which may indicate the health of the anode. As a failsafe, many current water heater systems are equipped with a device that detects when water has started to collect in the pan under the water heater, and automatically shuts the water off.

Regardless of the rate at which an anode degrades, a sacrificial anode rod is only serviceable when the life expectancy of the rod can be reasonably approximated, which allows for a replacement anode to be installed before the anode is completely depleted and the tank fails. However, the life expectancy of an anode can vary drastically depending on water conditions, and more importantly, the condition of the insulating porcelain covering the steel tank. The greater exposure the steel tank has to the electrolyte, the faster the anode will degrade. As a result, it is imperative that the condition of the anode rod may be accurately monitored throughout the life of the rod.

Current systems attempt to determine the health of an anode rode so that a deteriorating anode may be replaced prior to failure of the water heater system. However, these systems fail to account for the fact that anode rods do not deplete uniformly as they corrode. Instead, the impurities found in the material of the anodes and the chemical composition of the electrolyte act to form pits in the rod, in a process known as pitting. Because current systems do not account for the pitting of the anode, they are only able to approximate the average or effective radius of the anode, which greatly impairs their ability to accurately determine the overall health of the anode.

For at least these reasons, there is a need for an improved anode which may be used in a water heater system, and a method of accurately monitoring the degradation and health of the anode during use.

SUMMARY

According to a first aspect of the disclosure, a sacrificial anode for a water heater system comprises a distal end, a proximal end, and a passage running longitudinally between the distal end and the proximal end. A first current carrying lead and a first voltage lead are connected to the distal end of the anode, while a second current carrying lead and second voltage lead are connected to the proximal end of the anode. The first current carrying lead and first voltage lead are fed from the distal end of the anode through the passage running longitudinally between the distal end and the proximal end of the anode. The passage is hollow to allow the first current carrying lead and first voltage lead to run from the distal end of the anode to the proximal end of the anode. The passage may also be filled with resin to secure the first current carrying lead and first voltage lead, and to electrically insulate the leads.

In one embodiment, the distal end comprises a first terminal for forming an electrical connection with the first current carrying lead and the first voltage lead, and the proximal end comprises a second terminal for forming an electrical connection with the second current carrying lead and second voltage lead. The first and second terminals comprise socket head screws, and the first and second current carrying leads and first and second voltage leads are secured to the distal and proximal ends of the anode using nuts.

The first and second current carrying leads are further connected to a resistor, such as a shunt resistor, while the first and second voltage leads are connected to a voltage source. A microcontroller is used to take voltage measurements from the voltage source.

In another embodiment, the distal and proximal ends comprise threaded interior portions configured for creating electrical connections with the first and second current carrying leads and first and second voltage leads.

In yet another embodiment, the anode further comprises a rod fed through the passage, which is configured to create an electrical connection with the first current carrying lead and first voltage lead, and the second current carrying lead and second voltage lead. In this embodiment, a weld is used to create an electrical connection between the rod and the first current carrying lead and the first voltage lead connected to the proximal end of the anode. A bullet connector is used to create an electrical connection between the rod and the first current carrying lead and the first voltage lead connected to the distal end of the anode. The rod may be solid and made of steel.

Finally, the disclosure further relates to a method of determining the health of the sacrificial anode described herein. The method includes using a microcontroller to measure the voltage drop across the first voltage lead connected to a distal end of the anode and a second voltage lead connected to the proximal end of the anode. The method further includes measuring the current flow between a first current carrying lead connected to the distal end of the anode and a second current carrying lead connected to the proximal end of the anode using the microcontroller. The voltage drop and current flow across the anode may be used to determine the total resistance drop across the anode using the microcontroller.

The resistance drop across the anode may then be used to measure the radius of the anode. Once the radius of the anode is determined, the cross-sectional area of the anode may be estimated using the measured radius. The amount of mass lost from the anode is determined using the estimated value for the cross-sectional area of the anode. Finally, the amount of mass lost from the anode is compared to the initial anode mass to determine a percentage value for the health of the anode.

BRIEF DESCRIPTION OF THE DRAWINGS

While the specification concludes with claims which particularly point out and distinctly claim this technology, it is believed this technology may be better understood from the following description of certain examples taken in conjunction with the accompanying drawings, in which like reference numerals identify the same elements and in which:

Figure 1:
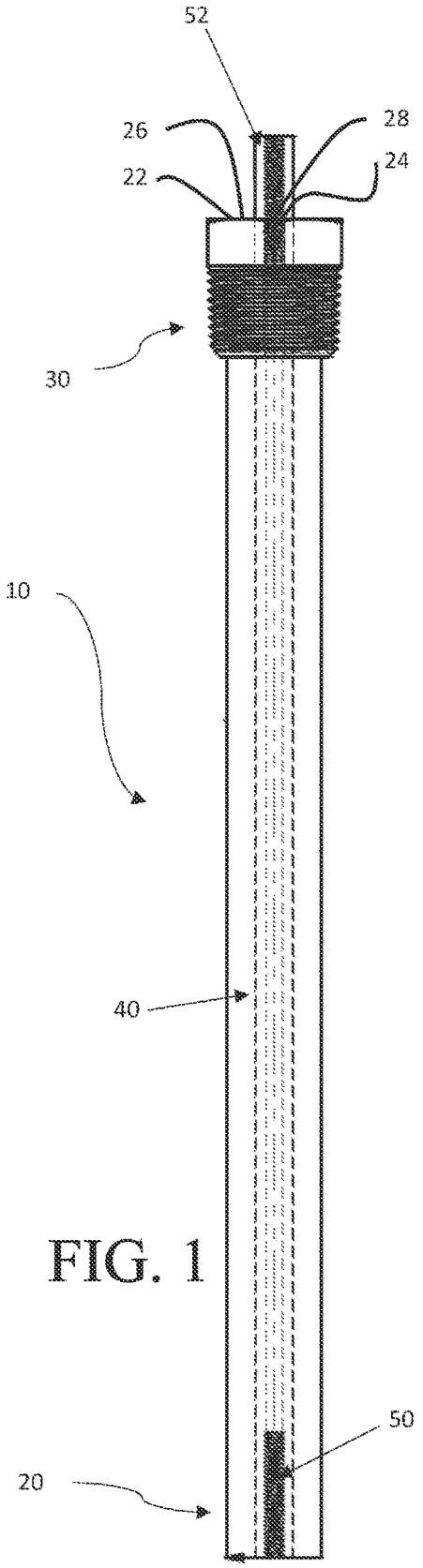
FIG. 1 depicts a sacrificial anode for a water heater system.

The drawings are not intended to be limiting in any way, and it is contemplated that various embodiments of the technology may be carried out in a variety of other ways, including those not necessarily depicted in the drawings. The accompanying drawings incorporated in and forming a part of the specification illustrate several aspects of the present technology, and together with the description serve to explain the principles of the technology; it being understood, however, that this technology is not limited to the precise arrangements shown.

DETAILED DESCRIPTION

The following description of certain examples of the technology should not be used to limit its scope. Other examples, features, aspects, embodiments, and advantages of the technology will become apparent to those skilled in the art from the following description, which is by way of illustration, one of the best modes contemplated for carrying out the technology. As will be realized, the technology described herein is capable of other different and obvious aspects, all without departing from the technology. Accordingly, the drawings and descriptions should be regarded as illustrative in nature and not restrictive.

I. Sacrificial Anode Overview

Figure 3:
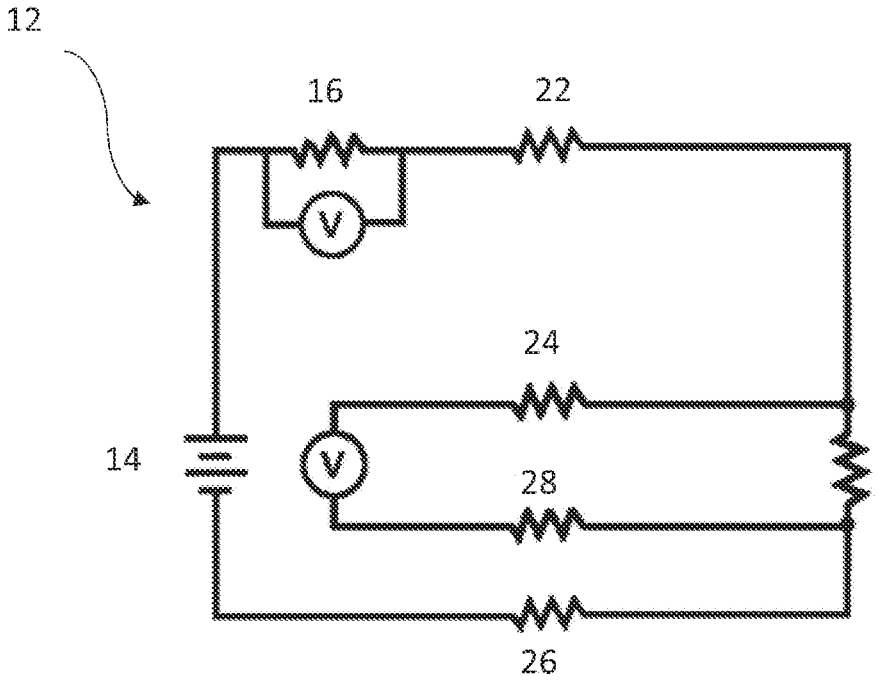
FIG. 3 depicts the electrical circuit used in connection with the sacrificial anode of FIG. 1.

As shown in the various figures, a sacrificial anode 10 for a water heater system is shown. The anode 10 may comprise a distal end 20, a proximal end 30, and a passage 40, such as a hollow steel passage, running longitudinally between the distal end 20 and the proximal end 30. As illustrated in FIG. 3, the anode may also comprise an electrical circuit 12, such as a kelvin circuit, which may include a voltage source 14 for supplying power to the anode 10, and a resistor 16, such as a shunt resistor, wherein the circuit 12 is used to determine the resistance across the anode 10. The electrical circuit 12 may also include a microcontroller for measuring the voltage across the anode 10.

The electrical circuit 12 may further comprise a first current carrying lead 22, a second current carrying lead 24, a first voltage lead 26, and a second voltage lead 28. The first and second current carrying leads 22, 24 may be connected to the resistor 16, while the first and second voltage leads 26, 28 may be connected to a voltage source 14, such as a 12.2 V supply. The first current carrying lead 22 and first voltage lead 26 may be connected to the distal end 20 of the anode 10, while the second current carrying lead 24 and second voltage lead 28 may be connected to the proximal end 30 of the anode. The first current carrying lead 22 and first voltage lead 26 may be connected to the distal end 20 of the anode 10 such that the first current carrying lead 22 is electrically insulated from the first voltage lead 26. Similarly, the second current carrying lead 24 and second voltage lead 28 may be connected to the proximal end 30 of the anode 10 such that the second current carrying lead 24 is electrically insulated from the second voltage 28. By separating the leads 22, 24, 26, 28 electrically, the contact resistance between the voltage source and the anode can be negated.

Figure 2:
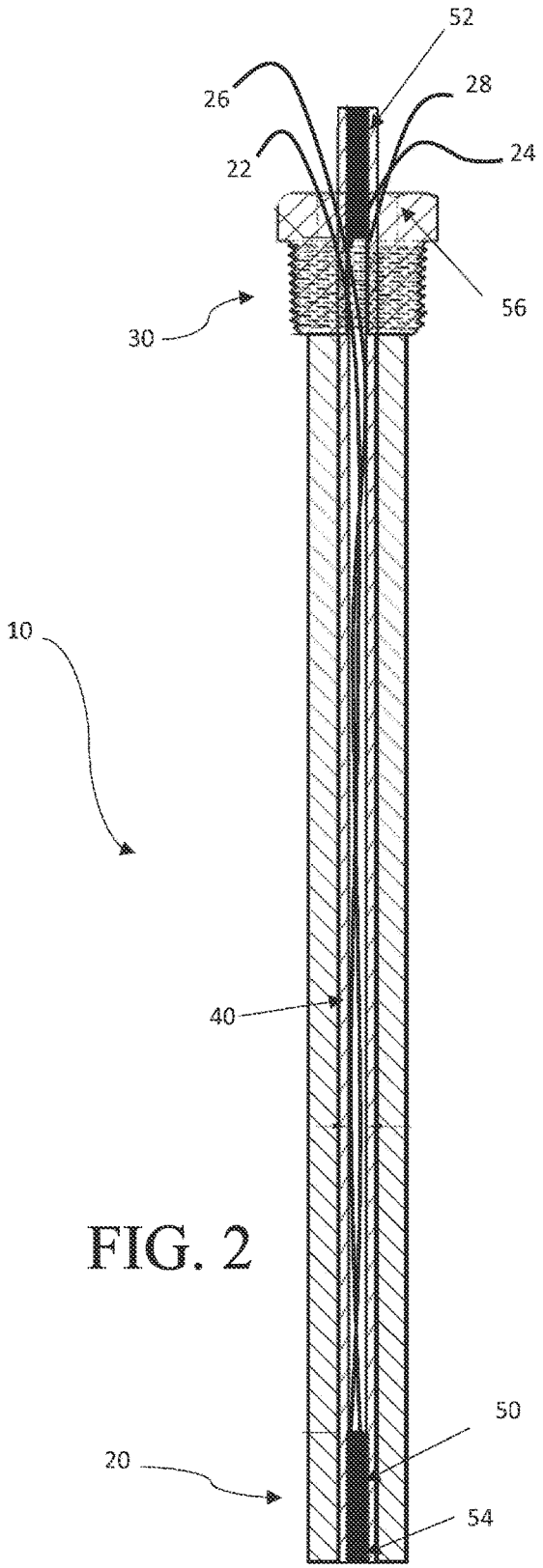
FIG. 2 depicts a cross-sectional view of the sacrificial anode of FIG. 1.

As most clearly illustrated in FIGS. 1 and 2, the first current carrying lead 22 and first voltage lead 26 may be connected to the distal end 20 of the anode 10 by way of first terminal 50, which may be located in the distal end 20 of the anode 10. Once the first current carrying lead 22 and first voltage lead 26 are secured to the first terminal 50, the first current carrying lead 22 and first voltage lead 26 may be fed through the passage 40 of the anode 10. The passage 40 may be hollow such that the first current carrying lead 22 and first voltage lead 26 may be fed through the passage 40 of the anode 10 and protrude from the proximal end 30 of the anode 10. In order to reduce signal noise, the first current carrying lead 22 and the first voltage carrying lead 24 may be fed through the passage 40 in a twisted configuration. The proximal end 30 of the anode 10 may comprise a second terminal 52, which may be used to connect with the second current carrying lead 24 and the second voltage lead 28. The passage 40 may be further filled with resin, or any other material suitable to secure the first current carrying lead 22 and first voltage lead 26 and provide electrical insulation.

Figure 4:
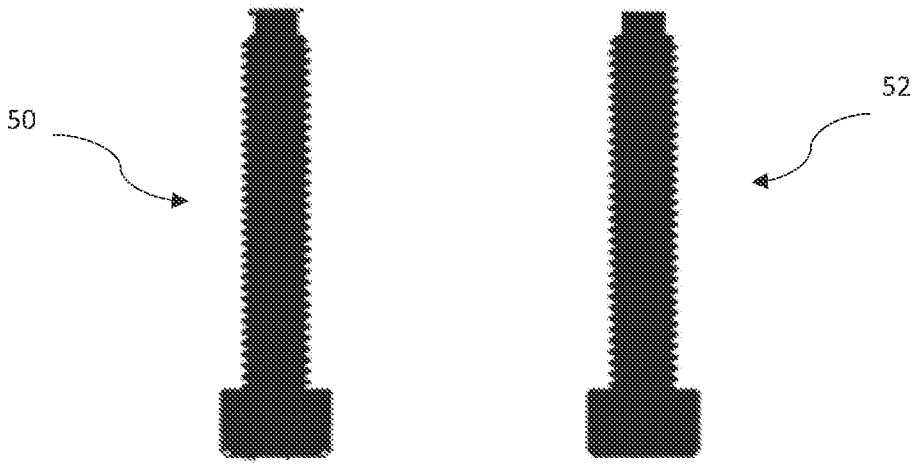
FIG. 4 depicts electrical terminals used in the sacrificial anode of FIG. 1.

FIG. 4 illustrates the first and second terminals 50, 52. The terminals 50, 52 may comprise socket head screws or other similar hardware. When the leads 22, 24, 26, 28 are connected to the first and second terminals 50, 52, respectively, an electrical connection is formed between the leads 22, 24, 26, 28 and the first and second terminals 50, 52 by way of the power supplied via the voltage source 14. In this configuration, the leads 22, 24, 26, 28 may be secured to the terminals 50, 52 by way of first and second nuts 54, 56, but may further be secured by any other suitable means.

Once an electrical connection has been established between the leads 22, 24, 26, 28 and the first and second terminals 50, 52, the leads 22, 24, 26, 28, resistor and voltage supply create the circuit 12, such as a kelvin circuit, which may be used to measure the resistance across the anode 10. After determining the resistance across the anode 10, this data may be utilized to further analyze the radius of the anode 10 for purposes of determining the health and condition of the anode 10 during use.

Figure 5:
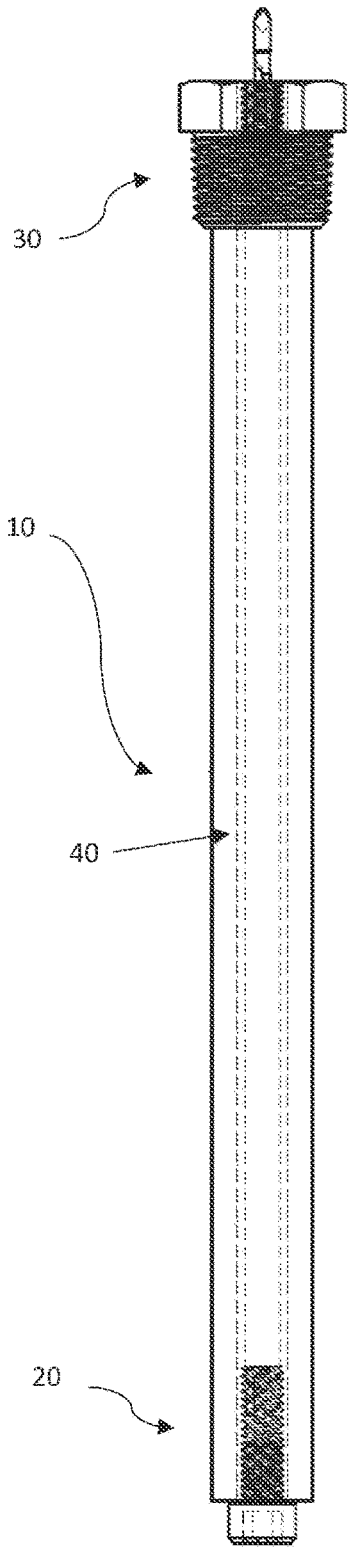
FIG. 5 depicts a second embodiment of a sacrificial anode for a water heater system.
Figure 6:
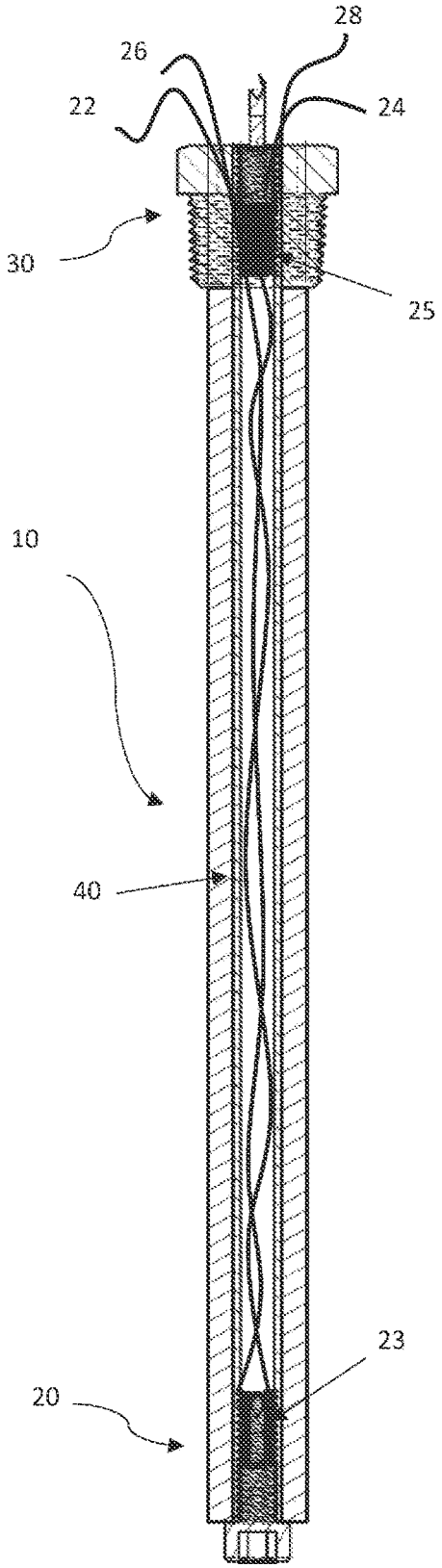
FIG. 6 depicts a cross-sectional view of the sacrificial anode of FIG. 5.

FIGS. 5 and 6 illustrate an alternate embodiment of the sacrificial anode 10. In this embodiment, the anode 10 may comprise a distal end 20, a proximal end 30, and a passage 40, such as a hollow steel passage, running longitudinally between the distal end 20 and the proximal end 30. The anode 10 may further comprise an electrical circuit 12, such as a kelvin circuit, which may include a voltage source 14 for supplying power to the anode 10, and a resistor 16, such as a shunt resistor, wherein the circuit 12 is used to determine the resistance across the anode 10.

The electrical circuit 12 may further comprise a first current carrying lead 22, a second current carrying lead 24, a first voltage lead 26, and a second voltage lead 28. The first and second current carrying leads 22, 24 may be connected to a resistor 16, such as a shunt resistor, while the first and second voltage leads 26, 28 may be connected to a voltage source 14, such as a 12.2 V voltage supply. The first current carrying lead 22 and first voltage lead 26 may be connected to the distal end 20 of the anode 10, while the second current carrying lead 24 and second voltage lead 28 may be connected to the proximal end 30 of the anode. The first current carrying lead 22 and first voltage lead 26 may be connected to the distal end 20 of the anode 10 such that the first current carrying lead 22 is electrically insulated from the first voltage lead 26. Similarly, the second current carrying lead 24 and second voltage lead 28 may be connected to the proximal end 30 of the anode 10 such that the second current carrying lead 24 is electrically insulated from the second voltage 28. By separating the leads 22, 24, 26, 28 electrically, the contact resistance between the voltage source 14 and the anode 10 can be negated.

As best illustrated in FIG. 6, the distal end 20 of the anode 10 and the proximal end 30 of the anode 10 may both comprise threaded portions 23, 25. The threaded portion 23 of the distal end 20 may be used to secure the first current carrying lead 22 and first voltage lead 26, while the threaded portion 25 of the proximal end 30 may be used to secure the second current carrying lead 24 and second voltage lead 28. Securing the leads 22, 24, 26, 28 via the threaded portions 23, 25 of the distal 20 and proximal ends 30 of the anode 10, respectively, ensures that the electrical connections are maintained throughout the anode 10. Once the first current carrying lead 22 and the first voltage lead 26 have been threaded into the threaded portion 23 of the distal end 20 of the anode 10, the leads 22, 26 may be fed through the passage 40 of the anode 10, such that the leads 22, 26 protrude from the proximal end 30 of the anode 10.

Once an electrical connection has been established between the leads 22, 24, 26, 28 and the threaded portions 23, 25 of the distal and proximal ends of the anode 20, 30, the leads 22, 24, 26, 28, resistor and voltage supply create the circuit 12, such as a kelvin circuit, which may be used to measure the resistance across the anode 10. After determining the resistance across the anode 10, this data may be utilized to further analyze the radius of the anode 10 for purposes of determining the health and condition of the anode 10 during use.

Figure 7:
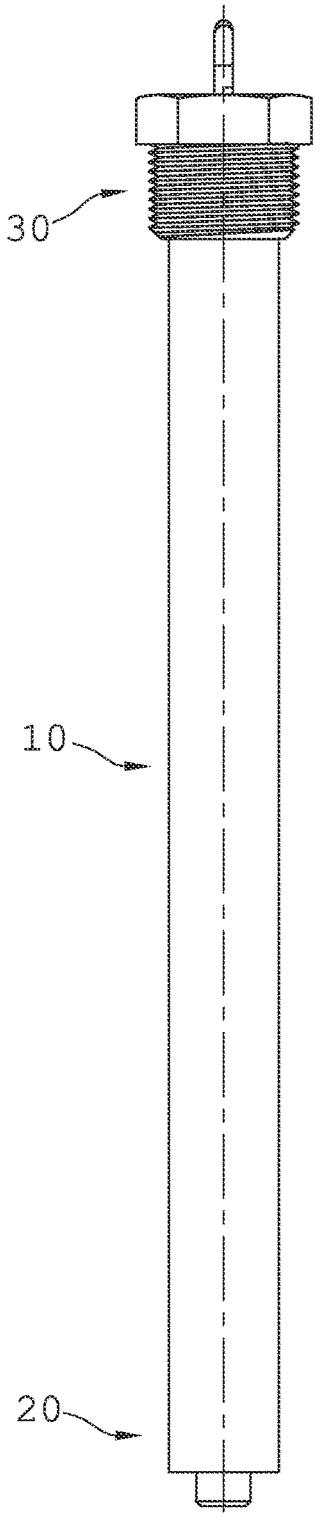
FIG. 7 depicts a third embodiment of a sacrificial anode for a water heater system.
Figure 8:
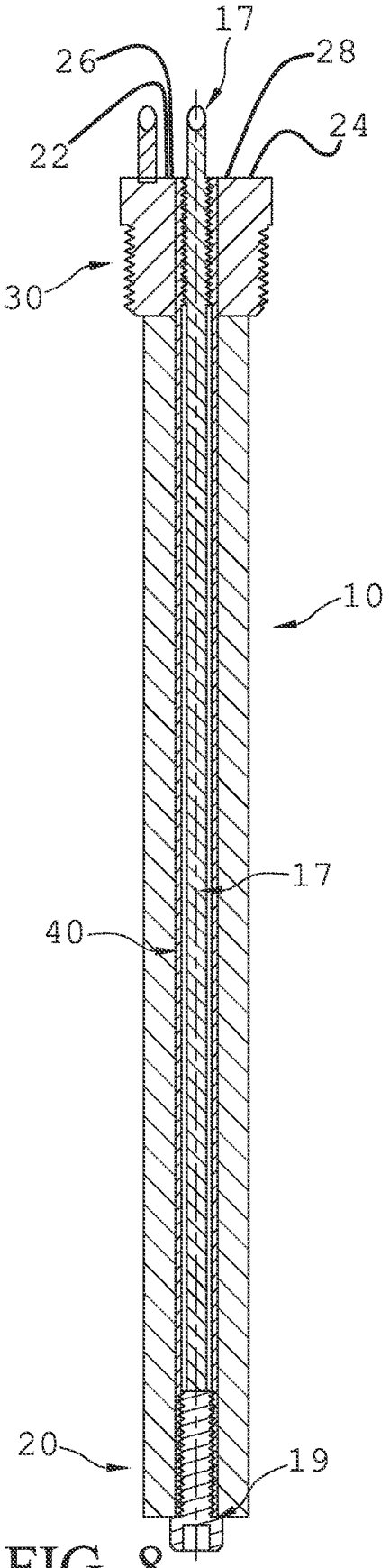
FIG. 8 depicts a cross-sectional view of the sacrificial anode of FIG. 7.

FIGS. 7 and 8 illustrate an alternative embodiment of the sacrificial anode 10. In this embodiment, the anode 10 may comprise a distal end 20, a proximal end 30, and a passage 40, such as a hollow steel passage, running longitudinally between the distal end 20 and the proximal end 30. The anode 10 may further comprise an electrical circuit 12, such as a kelvin circuit, which may include a voltage source 14 for supplying power to the anode 10, and a resistor 16, such as a shunt resistor, wherein the circuit 12 is used to determine the resistance across the anode 10.

The electrical circuit 12 may further comprise a first current carrying lead 22, a second current carrying lead 24, a first voltage lead 26, and a second voltage lead 28. The first and second current carrying leads 22, 24 may be connected to a resistor 16, such as a shunt resistor, while the first and second voltage leads 26, 28 may be connected to a voltage source 14, such as a 12.2 V voltage supply. The first current carrying lead 22 and first voltage lead 26 may be connected to the distal end 20 of the anode 10, while the second current carrying lead 24 and second voltage lead 28 may be connected to the proximal end 30 of the anode. The first current carrying lead 22 and first voltage lead 26 may be connected to the distal end 20 of the anode 10 such that the first current carrying lead 22 is electrically insulated from the first voltage lead 26. Similarly, the second current carrying lead 24 and second voltage lead 28 may be connected to the proximal end 30 of the anode 10 such that the second current carrying lead 24 is electrically insulated from the second voltage 28. By separating the leads 22, 24, 26, 28 electrically, the contact resistance between the voltage probe and the anode can be negated.

As most clearly illustrated in FIG. 8, the anode 10 may further comprise a rod 17, such as a solid steel rod, which runs through the passage 40, such as a hollow steel passage, which extends longitudinally from the distal end 20 to the proximal end 30 of the anode 10. In this configuration, the first current carrying lead 22 and first voltage lead 26 connected to the distal end 20 of the anode 10 form an electrical connection with the rod 17 by way of a connector 19, such as a bullet connector, which enables the circuit 12 to be completed with low contact resistance. The second current carrying 24 lead and second voltage 28 lead connected to the proximal end 30 of the anode 10 may form an electrical connection with the rod 17 through the use of a weld. In an alternative embodiment, the electrical connection with the rod 17 and the second current carrying lead 24 and second voltage lead 28 may be formed through the use of a press-fit connection.

Once an electrical connection has been established between the leads 22, 24, 26, 28 and the rod 17, the leads 22, 24, 26, 28, resistor and voltage supply create the circuit 12, such as a kelvin circuit, which may be used to measure the resistance across the anode 10. After determining the resistance across the anode 10, this data may be utilized to further analyze the radius of the anode 10 for purposes of determining the health and condition of the anode 10 during use.

One issue that arises in this configuration is that the contact resistance between the connector 19 and the anode 10 will need to be taken into consideration when determining the resistance of the anode 10. In order to alleviate this issue, standard electrical connectors may be used to maintain the circuit 12, and separate electrical connectors, such as alligator clips or crimp connected ferrules, may be placed in parallel with the circuit 12 such that the contact resistance is not contained in any voltage measurements.

II. Method of Determining Anode Health Overview

Further disclosed is a method of determining the health of an anode 10 as described in the embodiments presented herein. The health of the anode 10 may be approximated as a function of the measured change in anode mass compared to the original anode mass.

In order to determine the change in anode mass, the resistance across the anode must be measured. Initially, determining the value of the resistance across the anode may comprise measuring the voltage drop across the first voltage lead 26 connected to the distal end 20 of the anode 10 and the second voltage lead 28 connected to the proximal end 30 of the anode 10 using a microcontroller. The current across the anode 10 may also be determined by using the microcontroller to measure the current across the first current carrying lead 22 connected to the distal end 20 of the anode 10 and the second current carrying lead 24 connected to the proximal end 30 of the anode 10. The measured voltage drop and current may then be used to determine the resistance across the anode using Ohm's law, where the value of the resistance across the anode is equal to the voltage drop divided by the measured current.

Once the resistance across the anode is determined, the method may further comprise determining the radius of the anode as a function of the resistance across the anode. In this embodiment, the radius of the anode may be determined using the following calculation:

$$r_a = \sqrt{\frac{\rho_s \rho_a L + \pi\left(r_0^2 \rho_a - r_s^2(\rho_a - \rho_s)\right)\left(\overline{R} - R_{ext}\right)}{\pi\left(\overline{R} - R_{ext}\right)\rho_s}}$$

where R is the total resistance across the anode 10, $R_{ext}$ is the value of any additional resistance added to the circuit 12, $\rho_s$ is the electrical resistivity of the passage 40 of the anode 10, $\rho_a$ is the electrical resistivity of the anode 10, L is the length of the entire anode 10, $r_s$ is the (constant) radius of the passage 40, $r_0$ is the radius of any hollowed out portion of the steel passage that is concentric with the cylindrical anode, and $r_a$ is the radius of the anode 10.

Although it is possible to simply utilize the radius of the anode 10 to estimate the health of the anode 10, it is important to consider that the anode 10 may not corrode uniformly during use. Oftentimes, the anode 10 will form pits as it begins to corrode, which may result from impurities in the material of the anode 10, such as steel, in a process known as pitting. In order to compensate for any potential pitting, the method may further comprise determining the average cross-sectional area of the anode 10 based on the determined radius of the anode 10. The average-cross sectional area of the anode 10 maybe determined by measuring the integral over the anode 10 of the square of the anode radius, such that:

$$\pi \frac{\int_0^L \left(r_a(x)^2 dx\right)}{L} = [A_{anode}]_{mean}$$

where $r_a$ is the radius of the anode 10, L is the length of the entire anode 10, and $A_{anode}$ is the average cross-sectional are of the anode 10 across the total length L of the anode 10.

The cross-sectional area of the anode 10 may then be used to determine the total mass loss of the anode using the following equation:

$$\Delta m_a = \varphi L \Delta [A_{anode}]_{mean}$$

where $m_a$ is the mass of the anode 10 and φ is the density of the anode 10.

After determining the mass of the anode, the method may further comprise comparing the anode mass to the initial anode mass to determine the health of the anode. Specifically, the health of the anode 10 may be represented as a percentage by dividing the total mass loss by the initial anode mass. When the health of the anode has fallen below an acceptable percentage threshold, the method may further include using the microcontroller to warn a user that the water heater anode 10 is approaching failure. In addition to sending a warning via the microcontroller, the method may include automatically cutting off power to the water heater system when the percentage falls below an acceptable threshold.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Having shown and described various embodiments, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not necessarily required. Accordingly, the scope of the present invention should be considered in terms of the claims and is understood not to be limited to the details of structure and operation shown and described in the specification and drawings.

The invention claimed is:

1. A sacrificial anode for a water heater system comprising:

a distal end, a proximal end, and a passage running longitudinally between the distal end and the proximal end;

a first current carrying lead and a first voltage lead connected to the distal end of the anode; and a second current carrying lead and a second voltage lead connected to the proximal end of the anode;

wherein the first current carrying lead and first voltage lead are fed from the distal end of the anode through the passage running longitudinally between the distal end and the proximal end of the anode.

2. The anode of claim 1, wherein the passage is hollow.

3. The anode of claim 2, wherein the passage is filled with resin.

4. The anode of claim 1, wherein the distal end comprises a first terminal for forming an electrical connection with the first current carrying lead and first voltage lead, and the proximal end comprises a second terminal for forming an electrical connection with the second current carrying lead and second voltage lead.

5. The anode of claim 4, wherein the first and second terminals comprise socket head screws.

6. The anode of claim 4, wherein the first current carrying lead and first voltage lead are secured to the first terminal using a nut.

7. The anode of claim 4, wherein the second current carrying lead and second voltage lead are secured to the first terminal using a nut.

8. The anode of claim 4, wherein the first and second current carrying leads are further connected to a resistor.

9. The anode of claim 8, wherein the first and second voltage carrying leads are further connected to a voltage source.

10. The anode of claim 9, wherein the first and second current carrying leads, first and second voltage leads, resistor, and voltage source form a closed circuit for measuring the resistance across the anode.

11. The anode of claim 9, wherein a microcontroller is used to take voltage measurements from the voltage source.

12. The anode of claim 1, wherein both the distal and proximal ends comprise threaded interior portions configured for creating electrical connections with the first and second current carrying leads and first and second voltage leads.

13. The anode of claim 2, further comprising a rod fed through the passage, wherein the rod is configured to create an electrical connection with the first current carrying lead and first voltage lead connected to the distal end of the anode, and the second current carrying lead and second voltage lead connected to the proximal end of the anode.

14. The anode of claim 13, wherein a weld is used to create an electrical connection between the rod and the second current carrying lead and second voltage lead connected to the proximal end of the anode.

15. The anode of claim 13, wherein a press-fit connection is used to create an electrical connection between the rod and the second current carrying lead and second voltage lead connected to the proximal end of the anode.

16. The anode of claim 13, wherein a bullet connector is used to create an electrical connection between the rod and the first current carrying lead and the first voltage lead connected to the distal end of the anode.

17. The anode of claim 13, wherein the rod is made of steel.

18. The anode of claim 13, wherein the rod is solid.

* * * * *